US008763849B2

(12) United States Patent
Benetti

(10) Patent No.: US 8,763,849 B2
(45) Date of Patent: Jul. 1, 2014

(54) BOTTLE HAVING A REMOVABLE BOTTOM

(76) Inventor: Fabio Benetti, Sovizzo (IT)

( * ) Notice: Subject to any disclaimer, the term of this patent is extended or adjusted under 35 U.S.C. 154(b) by 0 days.

(21) Appl. No.: 13/884,395

(22) PCT Filed: Nov. 30, 2011

(86) PCT No.: PCT/EP2011/071343

§ 371 (c)(1),
(2), (4) Date: May 9, 2013

(87) PCT Pub. No.: WO2012/072661

PCT Pub. Date: Jun. 7, 2012

(65) Prior Publication Data

US 2013/0228544 A1 Sep. 5, 2013

(30) Foreign Application Priority Data

Nov. 30, 2010 (IT) ..... VI2010A0321

(51) Int. Cl.

| | |
|---|---|
| ***B65D 6/28*** | (2006.01) |
| ***A47G 19/22*** | (2006.01) |
| ***B65D 1/06*** | (2006.01) |
| ***B65D 23/00*** | (2006.01) |
| ***B65D 81/36*** | (2006.01) |
| ***B65D 51/24*** | (2006.01) |

(52) U.S. Cl.

CPC ..... *A47G 19/2255* (2013.01); *B65D 1/06* (2013.01); *B65D 23/001* (2013.01); *B65D 81/36* (2013.01); *B65D 51/249* (2013.01)

USPC ..... 220/625; 220/604; 220/614; 215/371; 215/376

(58) Field of Classification Search

USPC ..... 220/625, 604, 605, 606, 608, 614, 626, 220/629; 215/385, 370, 371, 376; 206/216, 206/217

See application file for complete search history.

(56) References Cited

U.S. PATENT DOCUMENTS

| | | | | |
|---|---|---|---|---|
| 2,086,404 | A | 7/1937 | Daniels | |
| 6,398,050 | B1 * | 6/2002 | Allora | 215/228 |
| 6,435,426 | B1 * | 8/2002 | Copp, Jr. | 239/346 |
| 6,729,488 | B2 * | 5/2004 | McNary et al. | 215/252 |
| 6,905,038 | B2 * | 6/2005 | Lopez | 215/228 |
| 2004/0118804 | A1 * | 6/2004 | Westerhold | 215/378 |
| 2005/0092760 | A1 | 5/2005 | Westerhold | |
| 2007/0284332 | A1 * | 12/2007 | Gowans et al. | 215/370 |

FOREIGN PATENT DOCUMENTS

| | | | |
|---|---|---|---|
| EP | 1 984 273 | B1 | 8/2010 |
| WO | 2007/090439 | A1 | 8/2007 |
| WO | 2009/024943 | A1 | 2/2009 |

OTHER PUBLICATIONS

International Search Report and Written Opinion dated Mar. 5, 2012, issued in PCT Application No. PCT/EP2011/071343, filed Nov. 20, 2011.

* cited by examiner

*Primary Examiner* — Robert J Hicks
*Assistant Examiner* — Kareen Rush
(74) *Attorney, Agent, or Firm* — Workman Nydegger

(57) ABSTRACT

A bottle (1; 20; 60) includes a shaped body (2; 67) and a removable bottom (3; 21; 61) provided with one or more shaped elements, wherein one of the shaped elements is pressure-fitted to the shaped body (2; 67) of the bottle (1; 20; 60).

17 Claims, 7 Drawing Sheets

BOTTLE HAVING A REMOVABLE BOTTOM

The present invention concerns a bottle particularly but not exclusively suited to contain beverages.

Bottles of different types and sizes for containing beverages are known.

Once the bottle has been opened, its contents are poured into a glass or the user can drink directly from the bottle in the case of small capacity bottles or single-portion bottles, or when there is no glass available.

For hygienic reasons it is always necessary to wash the glass once it has been used and this requires time.

In order to solve this problem, the present applicant filed patent EP 1 984 273 that protects a bottle provided with a removable bottom that can be screwed onto the body of the bottle itself. Said bottom is provided with a plurality of elastic projections spaced from one another and distributed along a circumference.

Once the bottom has been unscrewed from the body of the bottle, these elastic projections make it possible to constrain the bottom to the lid of the bottle once the latter has been overturned.

In this way, the bottom of the bottle becomes the bottom of a glass, which allows the user to drink the contents of the bottle with no need to use external glasses. In practice, the bottle is changed into a glass.

However, this solution poses some drawbacks.

A first drawback lies in that the bottom is screwed onto the shaped body of the bottle and this does not always guarantee optimal tightness of the bottle itself.

A further drawback is due to the fact that unscrewing the bottom from the shaped body of the bottle is not a simple operation.

Another not less important drawback is due to the fact that it is not very hygienic to drink from this type of bottle-glass, as also the part of the bottle's body that once having been changed into a glass comes into contact with the user's lips is threaded, too.

The present invention aims to overcome the drawbacks listed above.

In particular, the main object of the present invention is to propose a bottle particularly suited to contain beverages, provided with a removable bottom that allows it to be changed into a glass and ensures better tightness compared to the bottles of known type.

It is a further object of the present invention to propose a bottle of the type described above that allows a more comfortable removal of the bottom from the shaped body, while at the same time ensuring greater compliance with hygiene rules.

The objects described above are achieved by the present invention concerning a bottle whose main characteristics are in accordance with the contents of the independent claim. Further characteristics of the invention are the subject of the dependent claims.

Advantageously, the bottle according to the invention ensures greater tightness thanks to the presence of a removable bottom comprising one or more shaped elements pressure-fitted to the shaped body of the same bottle.

Likewise advantageously, according to a variant embodiment, the removable bottom of the bottle according to the invention comprises a tightening collar that increases the tightness of the removable bottom. Said variant embodiment is particularly useful, as the tightening collar is a safety element that indicates if the bottle has already been opened.

Likewise advantageously, in the first and second embodiment illustrated herein the removable bottom of the bottle according to the invention is removed by the user just one second before drinking. In this way, the lid prevents the accidental introduction of foreign bodies that would come into contact with the beverage contained in the bottle.

Likewise advantageously, according to a further variant embodiment, the removable bottom of the bottle according to the invention comprises a metal counter-lid containing a polyethylene disc and contained at least partially in a truncated cone-shaped lid. The metal counter-lid is provided with a central swelling that, when pressed, opens its annular indentation towards the outside.

The objects and advantages described above will be highlighted in greater detail in the following description supplied as an indicative, non-limiting example with reference to the enclosed drawings, wherein.

Figure 1:
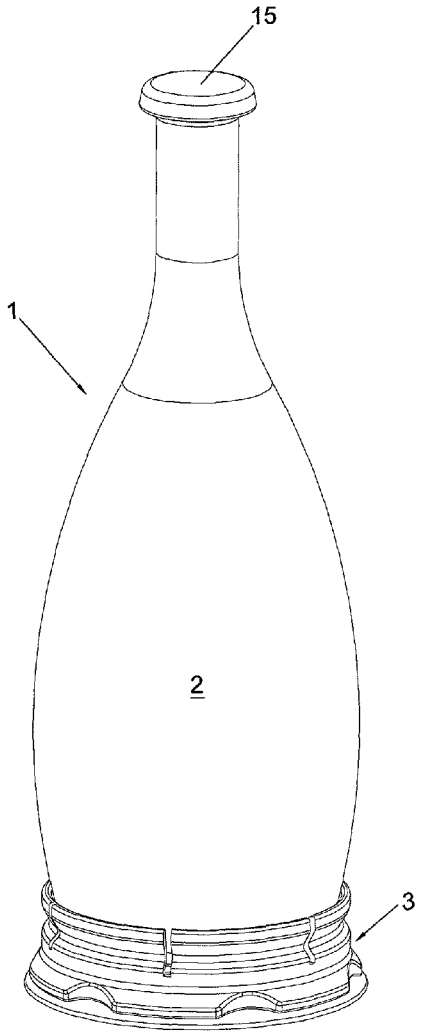
FIG. 1 shows an axonometric view of the bottle according to the invention.
Figure 3A:
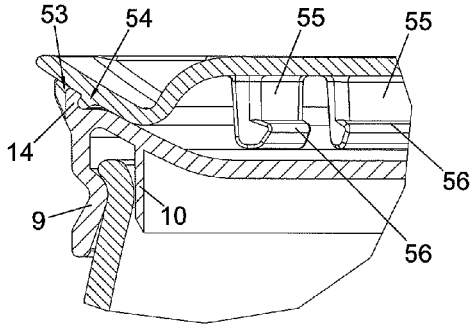
FIG. 3 shows a sectional view of the bottle shown in FIG. 2.
Figure 3:
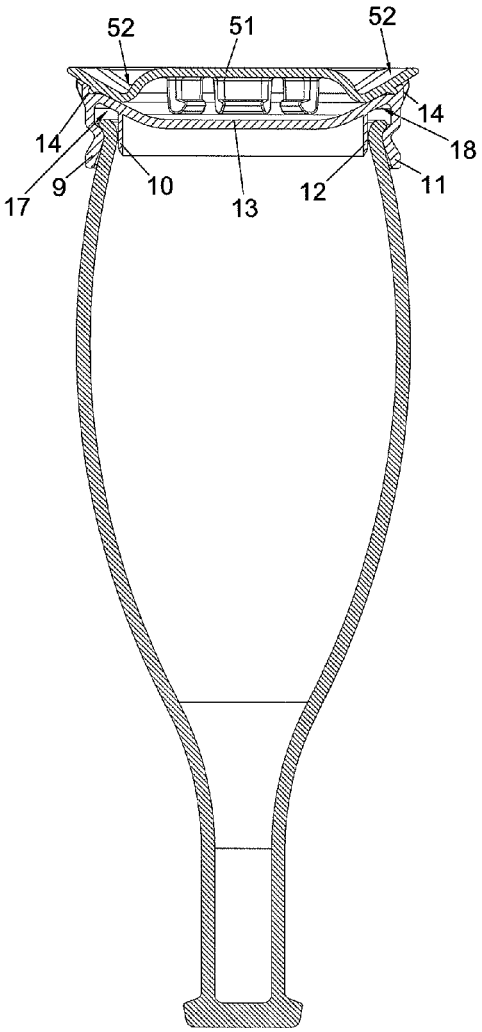
Figure 4:
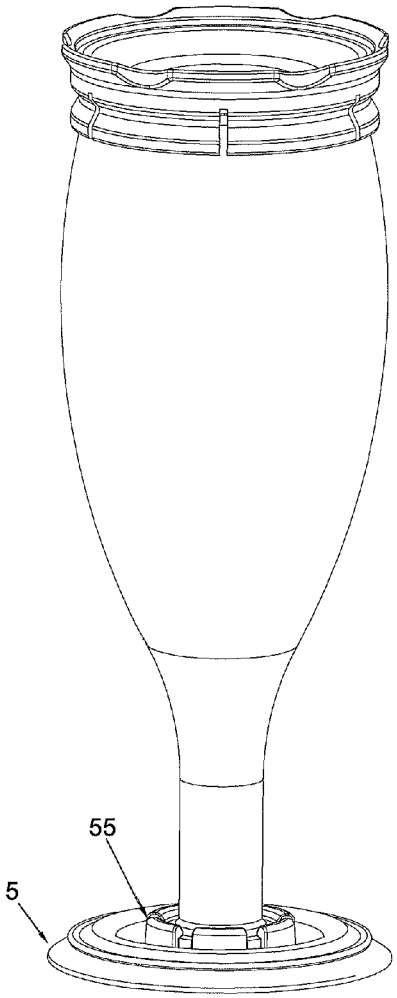
Figure 5:
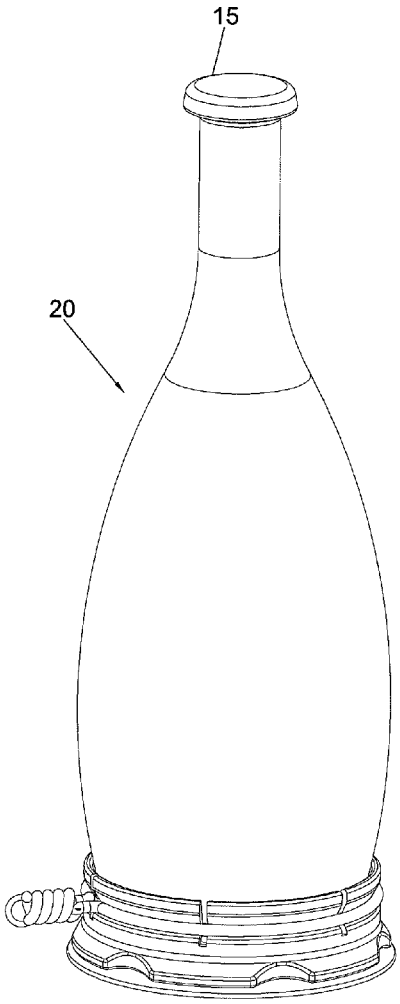
Figure 6:
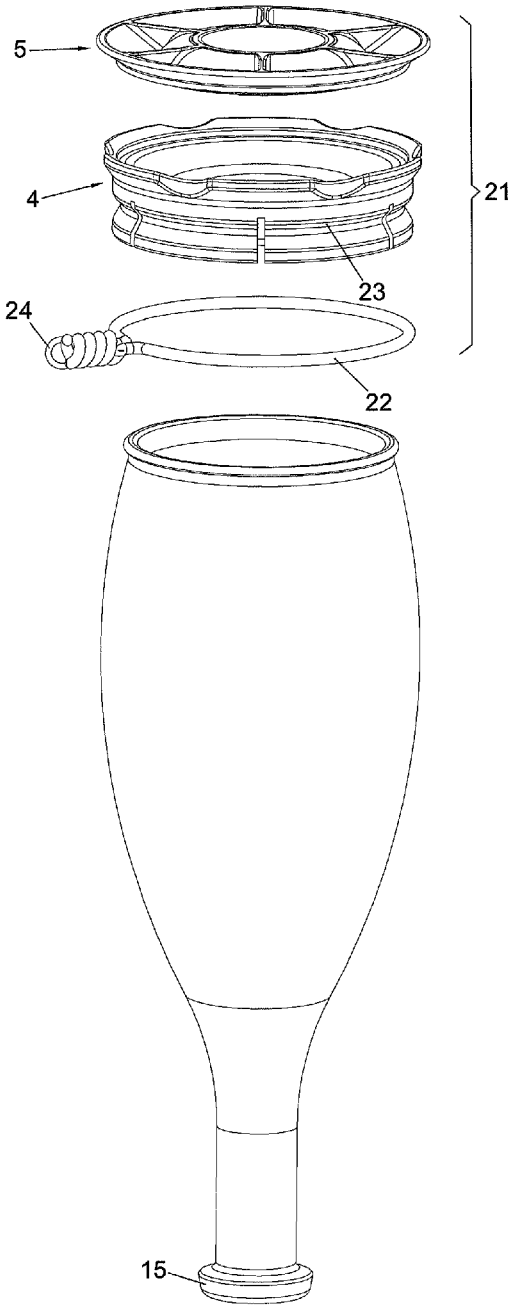
Figure 7A:
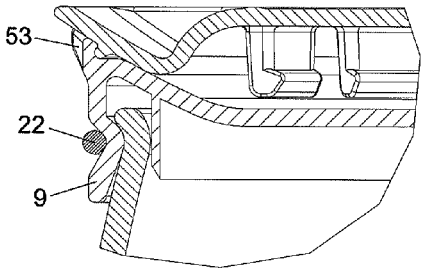
Figure 7:
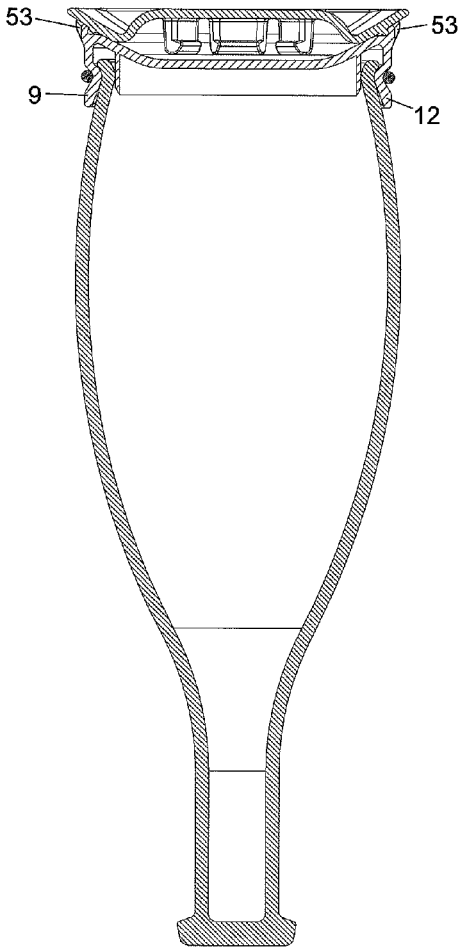
Figure 8:
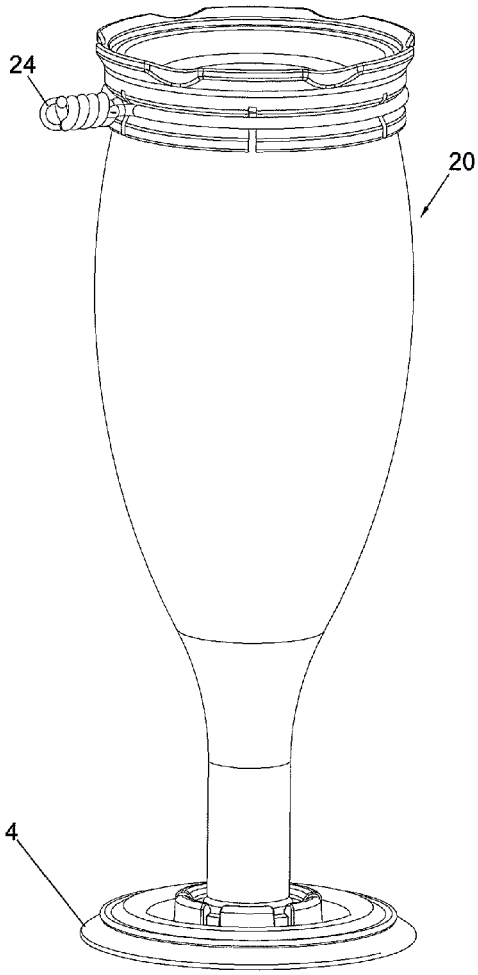
Figure 9:
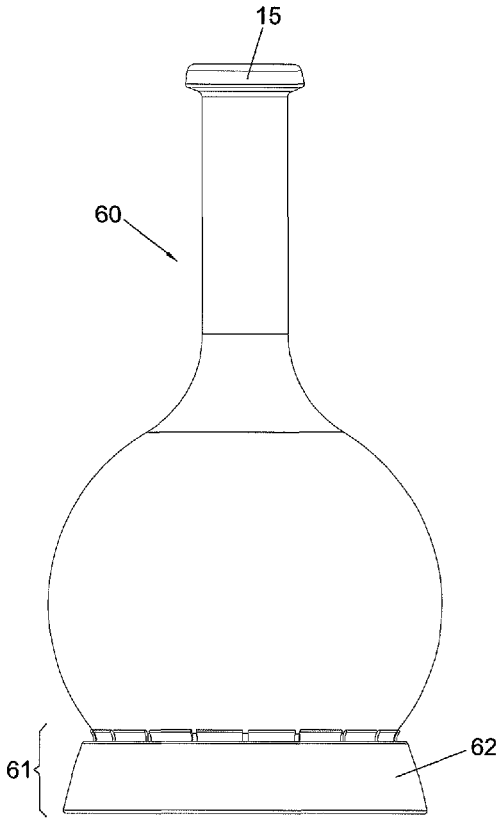
Figure 10:
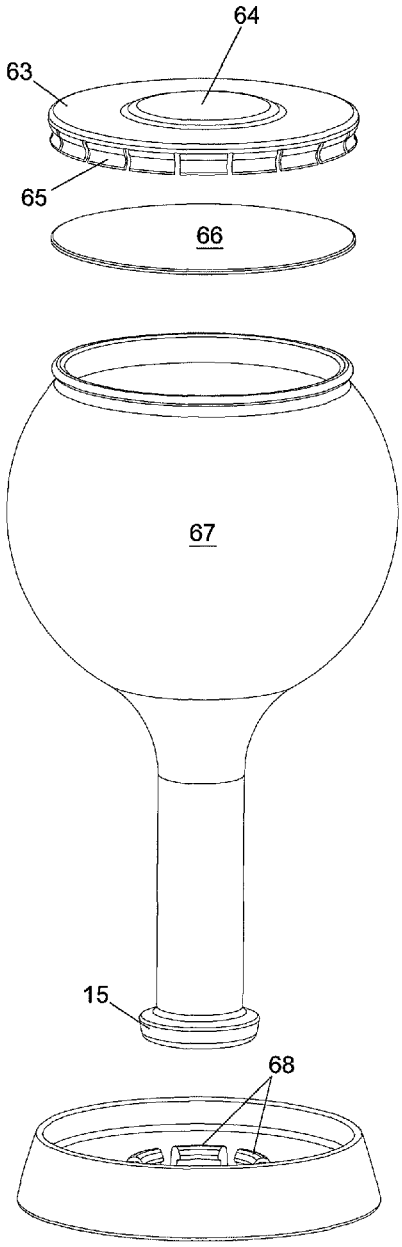
Figure 11:
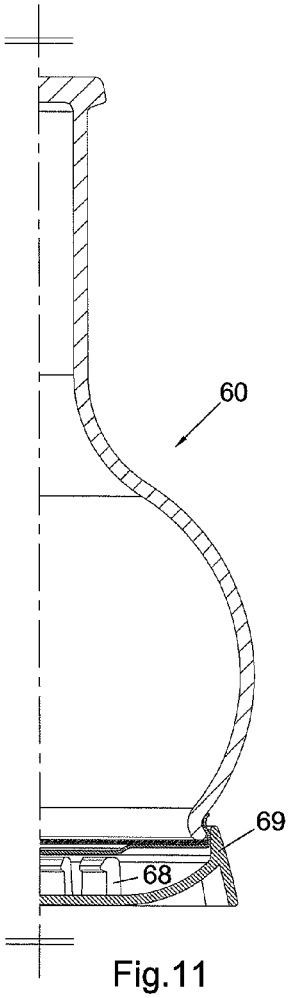
Figure 11A:
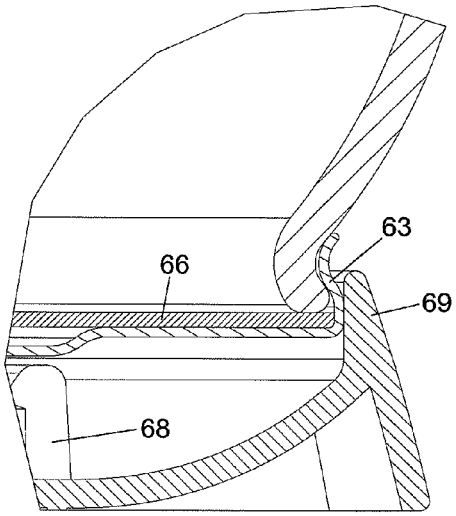
Figure 12:
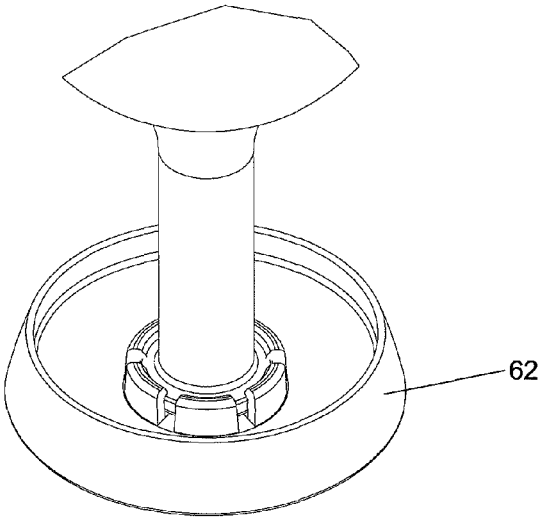
Figure 13:
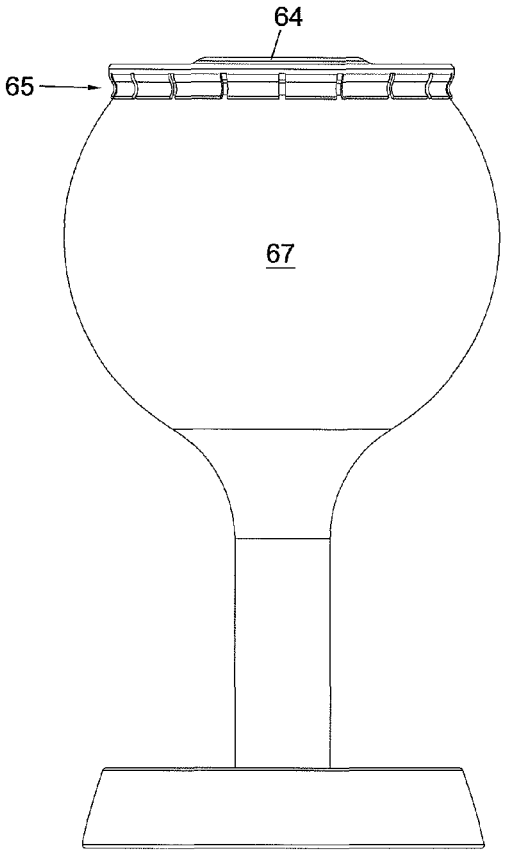

FIG. 3*a* shows a sectional view of a detail of FIG. 3;

FIG. 4 shows an axonometric view of the bottle shown in FIG. 1 in overturned position;

FIG. 5 shows an axonometric view of a variant embodiment of the bottle shown in FIG. 1;

FIG. 6 shows an exploded axonometric view of the bottle shown in FIG. 5;

FIG. 7 shows a sectional view of the bottle shown in FIG. 5 in overturned position;

FIG. 7*a* shows a sectional view of a detail of FIG. 7;

FIG. 8 shows an axonometric view of the bottle shown in FIG. 6 in assembled configuration;

FIG. 9 shows a front view of a further variant embodiment of the bottle shown in FIG. 1;

FIG. 10 shows an exploded axonometric view of the bottle shown in FIG. 9;

FIG. 11 shows a sectional view of the bottle shown in FIG. 9;

FIG. 11*a* shows a sectional view of a detail of FIG. 11;

FIG. 12 is an axonometric view of a detail of FIG. 10;

FIG. 13 shows a front view of the bottle shown in FIG. 10 in assembled configuration.

With reference to FIG. 1, the bottle according to the invention, indicated as a whole by 1, comprises a shaped body 2 and a removable bottom 3 provided with two shaped elements.

Figure 2:
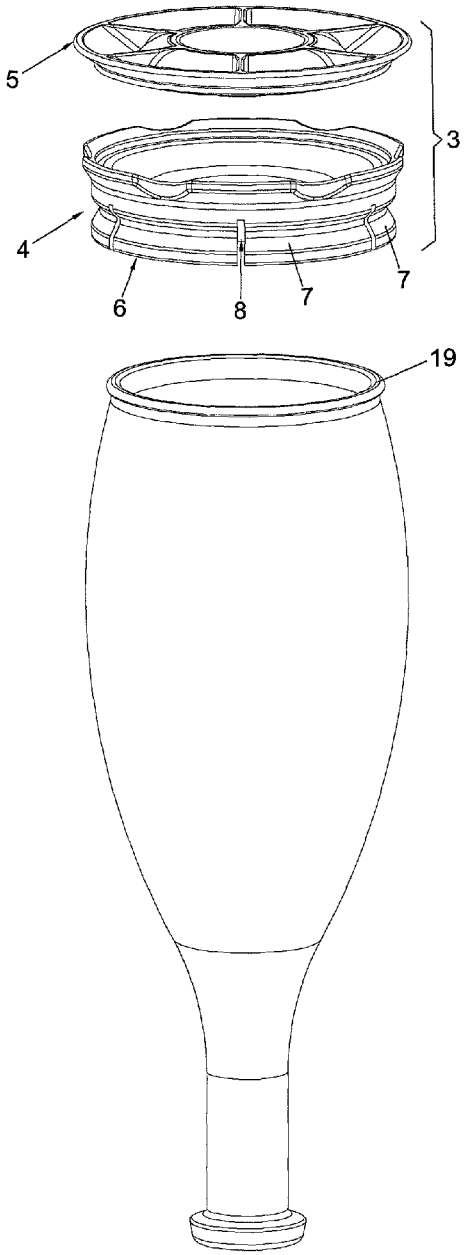
FIG. 2 shows an exploded axonometric view of the bottle shown in FIG. 1 in overturned position.

According to the present invention and with reference to FIG. 2, the shaped elements comprise a lid 4 that is pressure-fitted to the shaped body 2 of the bottle 1. The shaped elements of FIG. 2 also comprise a counter-lid 5 that is coupled to the lid 4.

The lid 4 is provided with an elastic edge 6 comprising a plurality of projections 7 spaced from one another by a plurality of slits 8.

With reference to FIG. 3 and above all to the detail of FIG. 3*a*, the coupling of the lid 4 to the shaped body 2 takes place by means of two pairs of elastic projecting elements belonging to it, respectively 9, 10, 11, 12.

The pair of elastic projecting elements 9, 10 is symmetrical to the projecting elements 11, 12 with respect to the longitudinal axis of the bottle 1 and both of the pairs 9 and 10, 11 and 12 define annular cavities, respectively 17 and 18, that accommodate the perimeter edge 19 of the shaped body 2.

Always with reference to FIG. 3*a*, the lid 4 has a delimiting surface 13 and two shaped protrusions 14 that are fixed into the counter-lid 5.

The counter-lid 5, in turn, comprises a central horizontal portion 51 connected to two lateral shaped portions 52.

The lateral portions 52 extend towards the lid 4 and are provided with two pairs of shaped counter-protrusions 53 and 54, wherein each pair is constrained to the shaped protrusions 14 of the lid 4 and is symmetrical to the other with respect to the longitudinal axis of the bottle 1.

Starting from the central portion 51 of the counter-lid 5 a plurality of shaped protruding elements 55 arranged along a circumference extend towards the inside of the bottle 1, each one of said shaped projections being provided with a tooth 56 for locking the cap 15 of the bottle 1 when this is overturned, as will be explained in greater detail below.

FIG. 5 shows a variant embodiment of the bottle 1, indicated now by 20, which differs from the first embodiment in that the removable bottom 21 is also provided with a tightening collar 22.

The tightening collar 22 is housed in the annular recess 23 provided in the lid 4 so as to ensure tightness.

It should be noted that the presence of the tightening collar 22 is a valuable safety element, in fact if tampering is noticed this means that the bottle has already been used.

FIG. 9 shows a further variant embodiment, now indicated by 60, which differs from the previous embodiments in that the removable bottom 61 comprises a truncated cone-shaped lid 62 which partially houses in its inner part a metal counter-lid 63 provided with a central swelling 64 and an annular indentation 65.

The metal counter-lid 63 contains a thin sealing disc 66, preferably made of polyethylene or a plastic material and glued inside the counter-lid 63 by means, for example, of food silicone or other glues in general.

As shown in FIG. 11 and in the detail of FIG. 11*a*, the annular indentation 65 of the counter-lid 63 slightly projects from the truncated cone-shaped lid 62 so that it can adapt to the shaped body 67 of the bottle 60.

As in the previous embodiments, the inside of the truncated cone-shaped lid 62 is provided with a plurality of elastic protruding elements 68 that with their teeth 56 constrain the cap 15 of the bottle 60 when this is overturned, as will be better explained below.

From an operational point of view, concerning the embodiment illustrated in FIGS. 1-4, when the user wants to use the bottle 1 as a glass, he/she presses the counter-protrusions 53 manually, in order to release the counter-lid 5 from the bottom 3 and overturns the bottle 1 without removing the cap 15. After overturning the bottle 1, the user exerts pressure on the cap 15 that has remained attached to the bottle 1 so that it gets caught in the teeth 56 within the circumferential area delimited by the elastic protruding elements 55.

The counter-lid 5 separated from the bottom 3 thus becomes the bottom of the glass, as shown in FIG. 4.

Lastly the user, pressing the elastic projecting elements 9 manually, separates the lid 4 from the shaped body 2 and can comfortably drink the beverage contained in the bottle 1.

From an operational point of view, concerning the second embodiment of the invention illustrated in FIGS. 5-8, the user first presses the counter-protrusions 53 manually, so as to release the counter-lid 5 from the removable bottom 21 and then overturns the bottle 20 and locks the cap 15 by means of the elastic protruding elements 55, as can be seen in FIG. 8.

Successively the user releases the tightening collar 22 by rotating the eyelet 24 manually and then removes the lid 4 by manually pressing the elastic projecting elements 9, 12 visible in FIG. 7.

From an operational point of view, concerning the third embodiment illustrated in FIGS. 9-13, the user presses manually the walls 69 of the truncated-cone shaped lid 62 and locks the cap 15 through the elastic protruding elements 68, as in the previous embodiments.

Successively, pressing manually the central swelling 64 of the counter-lid 63 opens the annular indentation 65 towards the outside, thus releasing the counter-lid 63 from its connection to the shaped body 67. In this way the user can drink the beverage contained in the bottle 60.

The above clearly shows that the bottle that is the subject of the invention achieves all the set objects.

In particular, the embodiment according to which the removable bottom of the bottle comprises a tightening collar constitutes an anti-tampering system that guarantees that nobody opened the bottle before the user.

Furthermore, in the first two embodiments described the lid of the removable bottom is removed by the user only when he/she is going to drink. The lid thus has the function of protecting the beverage from the accidental introduction of foreign bodies.

The bottle according to the invention is preferably made of plastic but also other materials can be used, for example glass or aluminium or ceramic or porcelain.

The bottle according to the invention can be subjected to modifications that must all be considered protected by the present patent, provided that they fall within the scope of the following claims.

Where technical features mentioned in any claim are followed by reference signs, those reference signs have been included for the sole purpose of increasing the intelligibility of the claims and accordingly such reference signs do not have any limiting effect on the protection of each element identified by way of example by such reference signs.

The invention claimed is:

1. Bottle comprising:

a shaped body; and a removable bottom provided with one or more shaped elements, at least one of said one or more shaped elements being pressure-fitted to said shaped body of said bottle, said shaped elements of said removable bottom comprising a lid and a counter-lid coupled with each other, wherein said counter-lid is provided with two pairs of shaped counter-protrusions that are constrained to said lid, one pair being symmetrical to the other with respect to the longitudinal axis of said bottle.

2. Bottle according to claim 1, wherein said lid is provided with an elastic edge in which it is possible to identify a plurality of projections spaced from each other by a plurality of slits.

3. Bottle according to claim 1, said lid being provided with means for coupling to said shaped body of said bottle.

4. Bottle according to claim 2, said lid being provided with means for coupling to said shaped body of said bottle.

5. Bottle according to claim 3, wherein said means for coupling comprises two pairs of elastic projecting elements that are symmetrical with respect to the longitudinal axis of said bottle, each one of said pairs defining an annular cavity that houses a perimeter edge of said shaped body.

6. Bottle according to claim 1, wherein said lid is also provided with one pair of shaped protrusions that are symmetrical to a second pair of shaped protrusions with respect to the longitudinal axis of said bottle.

7. Bottle according to claim 1, wherein said counter-lid is provided with a plurality of elastic protruding elements spaced from each other and distributed along a circumference.

8. Bottle according to claim 1, wherein said shaped elements of said removable bottom also comprise a tightening collar housed in an annular recess provided in an elastic edge of said lid.

9. Bottle comprising:

a shaped body; and a removable bottom provided with one or more shaped elements, at least one of said one or more shaped elements being pressure-fitted to said shaped body of said bottle, said shaped elements of said removable bottom comprising a lid and a counter-lid coupled with each other, said lid being in the shape of a truncated cone and said counter-lid being partially housed in said truncated cone-shaped lid.

10. Bottle according to claim 9, wherein said truncated cone-shaped lid is provided with a plurality of elastic protruding elements spaced from each other and distributed along a circumference.

11. Bottle according to claim 9, wherein said metal counter-lid is provided with a central swelling and an annular indentation.

12. Bottle according to claim 10, wherein said metal counter-lid is provided with a central swelling and an annular indentation.

13. Bottle comprising:

a shaped body; and a removable bottom provided with one or more shaped elements, at least one of said one or more shaped elements being pressure-fitted to said shaped body of said bottle, said shaped elements of said removable bottom comprising a lid and a metal counter-lid coupled with each other, said lid being in the shape of a truncated cone and said metal counter-lid being partially housed in said truncated cone-shaped lid, wherein said shaped elements also comprise a thin sealing disc inserted in said counter-lid.

14. Bottle according to claim 10, wherein said shaped elements also comprise a thin sealing disc inserted in said metal counter-lid.

15. Bottle according to claim 11, wherein said shaped elements also comprise a thin sealing disc inserted in said metal counter-lid.

16. Bottle according to claim 4, wherein said means for coupling comprises two pairs of elastic projecting elements that are symmetrical with respect to the longitudinal axis of said bottle, each one of said pairs defining an annular cavity that houses a perimeter edge of said shaped body.

17. Bottle accordingly to claim 9, wherein said counter-lid is metal.

* * * * *

UNITED STATES PATENT AND TRADEMARK OFFICE

CERTIFICATE OF CORRECTION

PATENT NO. : 8,763,849 B2
APPLICATION NO. : 13/884395
DATED : July 1, 2014
INVENTOR(S) : Benetti It is certified that error appears in the above-identified patent and that said Letters Patent is hereby corrected as shown below:

In the specification

Column 2
Line 64, change "perimeter edge 19" to --perimeter edge 19 (seen in FIG. 2)--

Column 3
Line 33, change "FIG. 11" to --FIG. 10--

In the claims

Column 6, Claim 17
Line 23, change "Bottle accordingly" to --Bottle according--

Signed and Sealed this
Tenth Day of May, 2016

Michelle K. Lee

Michelle K. Lee
*Director of the United States Patent and Trademark Office*